US005867860A

United States Patent [19]

Harris

[11] Patent Number: 5,867,860

[45] Date of Patent: Feb. 9, 1999

[54] RECIPROCATING HEAD FOR CLEANING TEXTILES AND METHOD OF USE

[75] Inventor: Robert Harris, Logan, Utah

[73] Assignee: Harris Research, Inc., Logan, Utah

[21] Appl. No.: 681,797

[22] Filed: Jul. 29, 1996

[51] Int. Cl.[6] ..... A47L 11/30

[52] U.S. Cl. ..... 15/320; 15/322; 15/380

[58] Field of Search ..... 15/320, 321, 322, 15/380, 381

[56] References Cited

U.S. PATENT DOCUMENTS

| | | | |
|---|---|---|---|
| 1,240,799 | 9/1917 | Gray . | |
| 1,472,208 | 10/1923 | Dawer | 15/320 |
| 1,766,425 | 6/1930 | Brockway . | |
| 2,570,679 | 10/1951 | Huber . | |
| 3,496,592 | 2/1970 | Jones . | |
| 3,616,482 | 11/1971 | Brycki . | |
| 4,014,067 | 3/1977 | Bates | 15/320 |
| 4,019,218 | 4/1977 | Cyphert . | |
| 4,069,541 | 1/1978 | Williams et al. . | |
| 4,095,309 | 6/1978 | Sundheim . | |
| 4,154,578 | 5/1979 | Bane | 15/320 X |
| 4,295,243 | 10/1981 | King | 15/320 |
| 4,488,330 | 12/1984 | Grave . | |
| 4,596,061 | 6/1986 | Henning . | |
| 4,939,808 | 7/1990 | Roden et al. | 15/380 X |

*Primary Examiner*—Chris K. Moore
*Attorney, Agent, or Firm*—Thorpe, North & Western, L.L.P.

[57] ABSTRACT

A cleaning machine includes a body, a head attached to the body and movable relative thereto in a reciprocating manner, and a motor mechanism for reciprocally moving the head. The cleaning machine also includes one or more spray nozzles for applying one or more solutions to the textile, and a suction head for reciprocating movement over the textile to agitate the textile and to remove the solution(s) and soil from the textile. Preferably, the cleaning machine includes two reciprocating heads which move in opposing directions so that each head offsets the vibrations produced by the other. In such a manner, a cleaning machine provides reduced fatigue for the operator while achieving improved cleaning.

19 Claims, 5 Drawing Sheets

RECIPROCATING HEAD FOR CLEANING TEXTILES AND METHOD OF USE

BACKGROUND OF THE INVENTION

1. Field of the Invention

The present invention relates to a cleaning device for textiles and a method for using the same. In particular, the present invention relates to a cleaning device which uses a reciprocating cleaning head for improved cleaning of carpets, upholstery and other textiles, and for methods for using such a cleaning device to achieve improved cleaning of the textiles.

2. Background Art

It is well known that in order to clean soil and other materials from textile such as carpet, the textile must be scrubbed or otherwise manipulated to encourage separation of the soil from the textile fiber. This is especially true when using a chemical agent in conjunction with negative pressure to remove the soil. Once sprayed on the textile fibers, the chemical agent must be worked into the fibers to chemically or physically interact with the soil and/or fibers to ensure proper separation of the soil from the textile.

After the chemical agent is worked into the fibers sufficiently to encourage release of the soil, the chemical agent and the soil must be extracted from the textile to prevent "brown out" and other problems associated with prolonged exposure of the carpet to moisture and high pH levels. This is typically accomplished by passing a high powered vacuum cleaner over the textile. However, even high powered vacuums have problems withdrawing sufficient amounts of water/cleaning agent to prevent browning in all carpets, upholstery, etc.

The several steps involved with such a cleaning process are of significant concern to those who often clean textiles such as carpet. Typically, the cleaning solution will be applied with a wand. Next, the area treated with cleaning solution is passed over by a buffing pad which agitates the textile, absorbs cleaning solution and encourages soils to separate from the fibers onto the pad. After the textile has been agitated, a suction device is drawn over the textile to remove additional the cleaning solution and soil. This process may be repeated several times until no more soil is removed by the buffing pad.

It has long been appreciated that considerable work could be saved by the use of a single cleaning device which applies the cleaning solution, agitates the textile, and applies suction to remove the cleaning solution and soil loosened from the fibers. Examples of devices designed to accomplish such steps simultaneously are shown in U.S. Pat. Nos. 1,240,799; 1,766,425; 3,496,592; 3,616,482; 4,019,218; 4,069,541; 4,095,309; 4,488,330; and 4,596,061.

Such devices, however, have met with limited success for several reasons. One common concern is a that the use of a reciprocating head, as is shown in several of the above-referenced patents, can cause a considerable amount of vibration in the device. Professional carpet cleaners can spend as much as four or five hours per day actively operating the cleaning devices, and the vibrations which often accompany such machines can cause considerable fatigue and even medical problems.

Another problem with such devices is that they are often difficult to control. When the user desires to stop the cleaning device, he or she will turn off the motor which reciprocates the cleaning head. Unfortunately, the reciprocating actuation is not stopped instantaneously. Rather, the user must hold the device in place or the reciprocating action will cause the head to move forward or rearward several inches. If the device accidentally creeps forward or rearward, cleaning solution may be sprayed on items such as lamp bases, molding and other structures which can be damaged by exposure to the cleaning solution.

Yet another problem with the currently available reciprocating cleaning devices is that they are only adapted for application of a single cleaning solution. For years it has been known that improved cleaning could be accomplished by the use of carbonated cleaning materials while limiting or eliminating the amount of surfactants used in the solution.

See U.S. Pat. No. 4,219,333. Further improvements were made in the use of carbonated cleaning solutions, as is described in U.S. Pat. No. 5,244,468. The patent teaches the preparation and use of an internally carbonated non-detergent cleaning composition. Carbon dioxide is generated by means of the reaction of an organic acid and a carbonate salt in solution. The invention improved on that disclosed in U.S. Pat. No. 4,219,333, by providing a composition which avoids the need for a pressurized carbon dioxide tank to carbonate the cleaning composition. Instead, the components of the composition react with one another to internally carbonate the solution. The carbonated composition is stored in a pressurized container after mixing to maintain carbonation in the composition until it is sprayed on the textile to be treated. The carbon dioxide carried in the solution then assists in the lifting of soils from the textile so that the same may be suctioned away.

Recently, however, it has been discovered that the benefits of a carbon dioxide effervescence can be increased significantly by having two or more solutions undergo a chemically or internally-carbonating reaction immediately before application to the textile, or while actually on the textile to be cleaned. Furthermore, it has been found that the cleaning ability of an effervescent chemically induced carbonating solution is greatly increased when the solution is heated to between 140° F. and 200° F. See U.S. Pat. No. 5,593,091 (U.S. patent application Ser. No. 08/335,210), which is expressly incorporated herein.

While effective, both of these methods of increasing the cleaning ability of the composition have physical restraints which significantly limit the ability to use the improvements with conventional applicators. In order to develop an internally-carbonating composition in which the reaction actually occurs on the textile, the solutions which react to release the carbon dioxide must be mixed either on the textile, or very shortly before application to the textile (typically almost instantaneously but not more than about 10–15 seconds).

One concern raised by reacting the chemicals which create the carbon dioxide effervescence is that the acid and carbonate salt base used to form the reaction can damage the textile fibers if they are not properly neutralized by each other. To ensure proper neutralization, the two chemicals must be adequately mixed together, or the acid and base must be buffered to ensure a safe pH range will not be exceeded. Considerable work can be expended by the user of the method attempting to ensure that the acid and base solutions on the textile are appropriately mixed. Additionally, the manual working of the mixture of the acid and base solutions is preferable to help break free soils on the textile.

Thus, there is a need for a new cleaning device which overcomes the disadvantages of the prior art. Preferably, such a cleaning device should minimize the vibration to which the user is subjected and should prevent accidental advancement when the machine is turned off. Additionally, such a machine should provide a mechanism for facilitating carbon dioxide effervescence, whether the reactant chemicals are mixed prior to application on the textile, or are combined on the textile.

SUMMARY OF THE INVENTION

Thus, it is an object of the present invention to provide a cleaning device with a reciprocating head which minimizes the amount of vibration to which the user is subjected.

It is another object of the invention to provide such a cleaning device which prevents accidental advancement of the cleaning device.

It is yet another object of the invention to provide a cleaning device which promotes carbon dioxide effervescence of two or more reacting chemicals used as a cleaning agent by mixing the chemicals coincident with their application to the textile.

It is still another object of the present invention to provide such a cleaning device which promotes carbon dioxide effervescence of two or more reacting chemical solutions by maintaining the solutions above room temperature until they are combined.

It still yet another object of the present invention to provide such a cleaning device which may be used with multiple different methods for enhancing the removal of soils from textiles.

The above and other objects of the invention not enumerated are realized in specific illustrated embodiments of a reciprocating head for cleaning textiles and the like including a body, a head attached to the body and movable relative thereto in a reciprocating manner, and a motor mechanism for reciprocally moving the head. The device also includes one or more spray nozzles for applying one or more solutions to the textile, and a suction head for removing the solution and soil from the textile.

In accordance with one aspect of the invention, a pair of plates are provided and disposed in an offsetting arrangement so as to counteract the undesirable vibration caused by moving the reciprocating head to agitate the textile and work the solution into the textile.

In accordance with another aspect of the invention, a pair of scrubbing pads are disposed on the plates to work the cleaning solution into the textile fibers and to remove soils from the carpet, upholstery, etc., as the plates move reciprocatingly.

In accordance with another aspect of the invention, the reciprocating head includes a first reciprocating member and a second reciprocating member. The first and second reciprocating members move in opposing directions to one another so as to minimize vibration caused by the reciprocation, and to prevent accidental advancement of the cleaning device.

In accordance with another aspect of the invention, the cleaning device is provided with fluid supply lines for applying an acid solution and a carbonate salt base solution to the textile which, when combined, react to generate carbon dioxide in an effervescing manner. In one method of the invention, heated acid and base solutions are combined momentarily before or at the time of application to the textile, after which an agitating pad is passed over the combined applied solutions to ensure that they mix sufficiently to enable proper neutralization, pH balance and maximum carbon dioxide generation.

In the alternative, the agitating pad may be omitted if the reciprocating head moves the suction head while the suction head is in firm contact with the textile. In such an arrangement, the suction head serve to agitate the textile and the cleaning composition disposed thereon to loosen soils on the textile.

In accordance with yet another aspect of the invention, the cleaning device is provided with a suction head which works the textile fibers as it moves back and forth without the use of pads. The head improves separation of soils from the textile, and promotes lifting of the soil from the textile fiber by enhancing carbon dioxide generation as the acid and carbonate salt base solutions react with one another.

Still another aspect of the present invention involves providing the cleaning device with a plurality of feed lines which can be connected to a solution heating device to keep both acid and base solutions hot prior to their combination and application to the textile.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
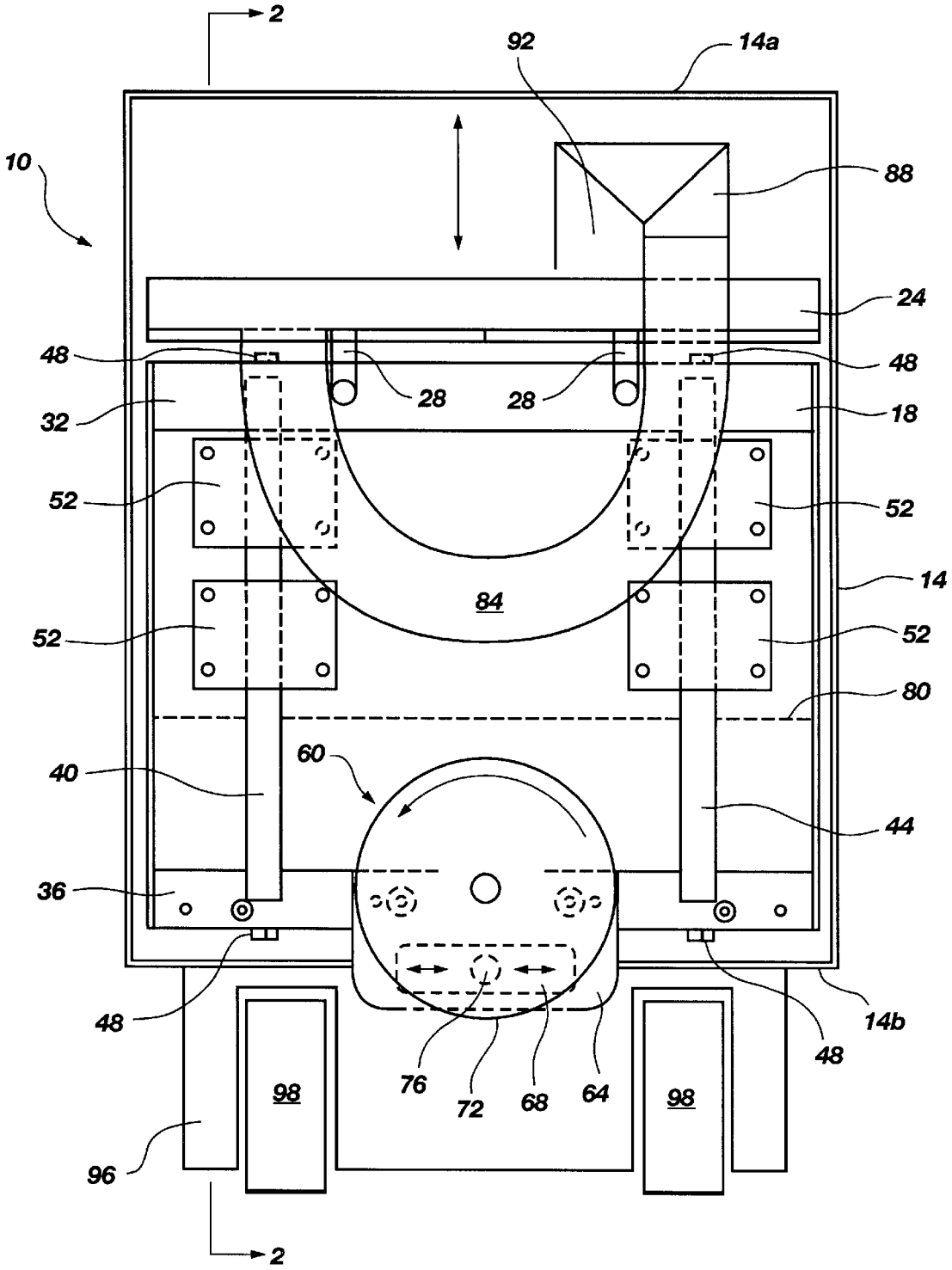
FIG. 1 shows a plan view of a cleaning device with a reciprocating head made in accordance with the principles of the present invention.

Referring to FIG. 1, there is shown a plan view of a cleaning machine, generally indicated at 10, which is formed by a housing 14, with a reciprocating head 18 disposed therein. The reciprocating head 18 moves horizontally in a linear back and forth motion within the housing to improve the distribution and effectiveness of cleaning solutions that are applied by the machine.

The reciprocating head 18 includes a vacuum/suction head 24 and a plurality of spray nozzles 28 which are positioned to spray cleaning solution on textiles disposed below the cleaning device. The vacuum/suction head 24 and the spray nozzles 28 are supported for the purpose of reciprocating movement by a first support bar 32. A second support bar 36 is also provided.

A pair of support shafts 40 and 44, respectively, interconnect the two support bars. Typically, each support shaft 40 or 44 is attached to the first and second support bars 32 and 36 by bolts 48 disposed at either end thereof. The support shafts 40 and 44 are mounted in linear bearings 52 which are stationary within the housing 14. The linear bearings 52 allow the reciprocating head 18 go move linearly and minimize the amount of vibration associated with the cleaning machine 10.

To move the reciprocating head 18 forwardly and rearwardly in a reciprocating manner, a reciprocating drive mechanism, generally indicated at 60, is disposed within the housing 14. As shown in FIG. 1, the reciprocating drive mechanism 60 includes a plate 64 which is attached to the second support bar 36 so as to extend rearwardly therefrom. Disposed in the plate 64 is an elongate slot 68.

The drive mechanism 60 also includes a gear 72. The gear 72 is driven by a motor which has been omitted from FIG. 1 for clarity. Rotation of the motor causes rotation of the gear 72. For reasons which will soon become apparent, the direction which the gear 72 is rotated is not significant.

The gear 72 interacts with the plate 64 by a small pin or dowel 76 which extends down into the slot 68. As the gear 72 rotates, the pin 76 slides within the slot 68 and forces the plate 64 to move forward and backward. Regardless of which direction the gear 72 rotates, the movement of the plate 64 will be substantially the same. The distance which the plate 64 moves will be approximately two times the distance of the pin 76 from the axis of rotation of the gear 72. Thus, if the pin is disposed 1.5 inches from the center of the gear 72, the stroke of the plate 64 and the reciprocating head 18 to which it is attached will be approximately 3 inches. As shown in FIG. 1, the reciprocating head 18 is in a fully retracted position. By rotating the gear 72 180 degrees, the second support bar 36 will be moved into the position marked by the dashed line 80, and the vacuum/suction head 24 will be moved to the front 14*a* of the housing 14.

One problem which has been associated with reciprocating vacuum cleaners is that the hose must be loose so as to prevent wear during the reciprocating action. However, the loose hose can cause a hazard if it extends outwardly from the machine. To resolve these concerns, the embodiment of the present invention shown in FIG. 1 uses an arcuate hose 84 to attach the vacuum/suction head 24 to a stationary vacuum attachment 88 connected to the housing. The arcuate hose 84 flexes as the reciprocating head 18 moves between a first, rearward position, shown in FIG. 1, and a second, forward position. Because of the arcuate nature of the hose 84, the stresses involved with repeated movement are spread across the entire length of the hose. This arrangement allows the hose 84 to be kept adjacent to the housing 14, while avoiding localized stresses which might cause premature failure of the hose.

The stationary vacuum attachment 88 has a receiving port 92 into which a conventional vacuum hose (not shown) may be attached for providing suction. Because the port 92 remains stationary, no unusual flexing is required of the conventional hose.

Disposed at a rearward end 14*b* of the housing is a support 96. The support 96 receives two wheels 98 which are used to help move the cleaning machine 10 along carpet or other textiles. When the reciprocating head 18 is not in use, the wheels can be used to transport the cleaning machine 10 by simply tilting the housing 14 rearwardly so that the weight of the machine is supported on the wheels.

Figure 2:
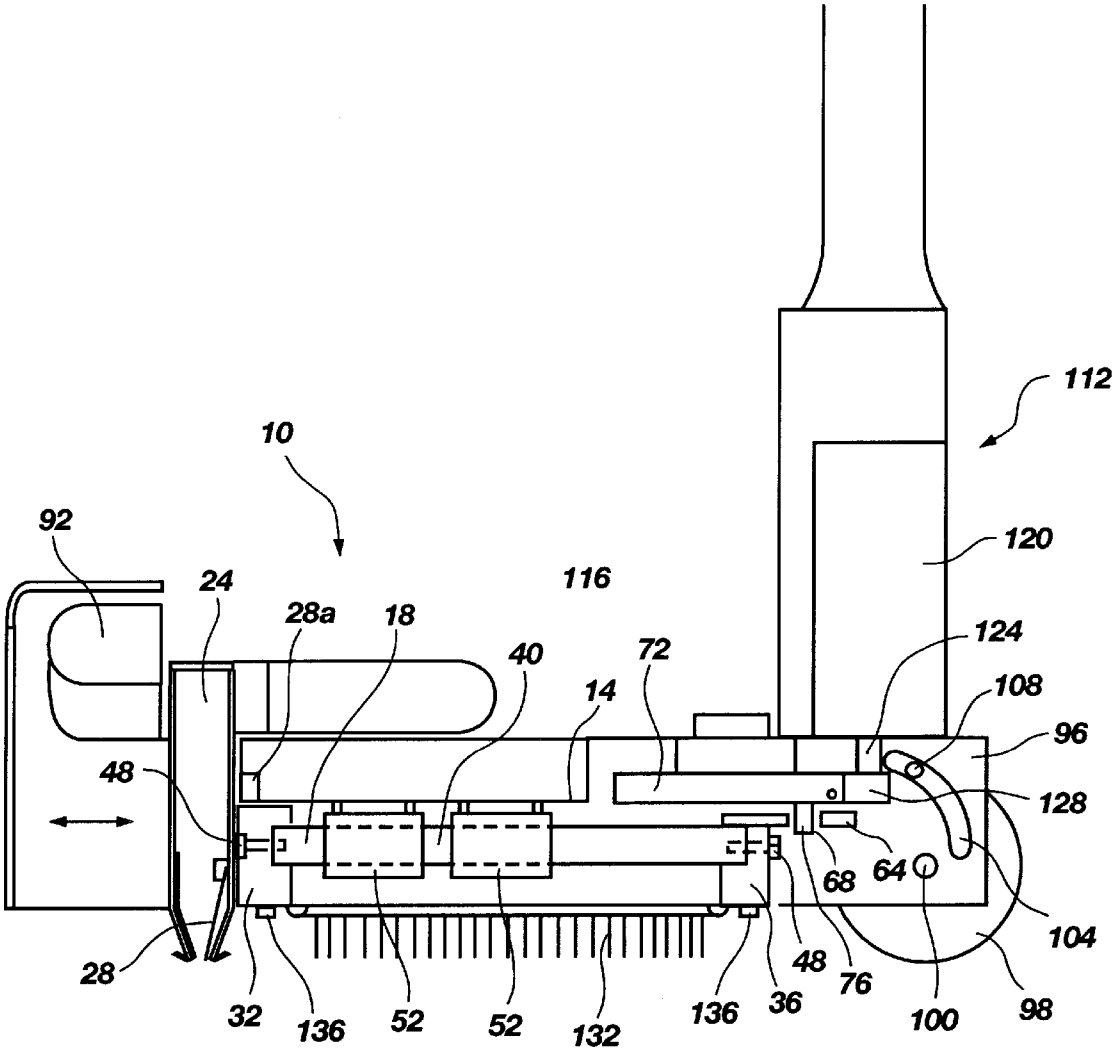
FIG. 2 shows a side cross-sectional view of the cleaning device shown in FIG. 1.

Referring now to FIG. 2, there is shown a fragmented, cross-sectional view of the cleaning machine 10 taken along the line 2—2 in FIG. 1. Beginning at the far right, the wheel 98 is attached to the support 96 by an axle 100 about which the wheel rotates. Disposed in the support 96 adjacent the wheel 98 is a slot 104. A pin 108 is disposed in the slot so as to enable a handle portion, generally indicated at 112, to pivot with respect to a base portion, generally indicated at 116.

Disposed in the handle portion 112 is a motor 120. A drive shaft 124 extends downwardly from the motor 120 and has a drive gear 128 disposed thereabout. The drive gear 128 extends outwardly into contact with the gear 72 which is disposed above the second support bar 36. Rotation of the drive shaft 124 by the motor 120 rotates the drive gear 128. The drive gear 128, in turn, rotates the gear 72 and moves the pin 76 in a circular manner. As the pin 76 moves, it slides within the slot 68 in the plate 64 which extends from the second support bar 36. Movement of the plate 64 forwardly and rearwardly by movement of the pin 76 causes the entire reciprocating head 18 to move in a reciprocating manner.

The reciprocating head 18 is supported by the linear bearings 52 which are disposed about the support shafts 40 and 44 (support shaft 44 not being shown in FIG. 2). To provide this support, the linear bearings are attached to the housing 14.

As the head 18 reciprocates, the cleaning machine 10 applies a cleaning solution to a textile such as carpet, agitates the textile fibers to facilitate penetration by the cleaning solution and release of soils, and suctions the cleaning solution and soil from the textile. As will be explained in detail below, such an arrangement can result in a novel method of cleaning textile fibers when two reactive chemical are supplied in sequence. The first chemical is able to penetrate a group of interlaced, wound, woven, etc. textile fibers to be cleaned. The second chemical is then added to react with the first chemical causing a reaction to occur at least partially within the group of fibers (or even within a single fiber). Thus, even though the sequential application of the two chemical solutions may occur only milliseconds apart, the cleaning of the textile fiber or group of fibers occurs from the inside out, rather than merely occurring on the surface of fiber/fibers as has traditionally been the case.

As is shown in FIG. 2, the cleaning machine 10 will typically be used in the following manner. First, as the machine 10 is pushed forward, cleaning solution is sprayed from the spray nozzles 28. The cleaning solution is supplied to an upper end of the spray nozzle 28*a* by feed lines which are not shown in FIG. 2, but which are discussed in detail with respect to FIG. 5. The solution provided may be a conventional cleaning solution but is preferably a combination of a hot carbonate salt solution and a hot acid solution which have been combined such that they are still reacting to generate carbon dioxide when the mixture passes through the spray nozzles 28 as described in U.S. Pat. No. 5,593,091 (Ser. No. 08/335,210). In the alternative, a carbonate solution and an acid solution could be provided independently so as to be mixed while being applied to the textile, or sprayed in sequence to have the complete reaction occur on the textile fibers themselves. Such an arrangement has been found to provide remarkable improvement in the cleaning ability of the chemicals.

Once the cleaning solution has been sprayed on the textile, it is contacted by an agitating means 132 which is attached to the first and second support bars 32 and 36, respectively, by a plurality of bolts 136 or some other retention device. The agitating means 132, such as a pad or brush, is suspended between the support bars and is disposed sufficiently low that such means will contact and agitate the textile to ensure complete penetration by and neutralization of the cleaning solution. In the event that the cleaning solution is formed by a combination of a carbonate solution and an acid solution, the agitation of the textile will help to ensure that the two solutions are mixed properly to neutralize the respective chemicals so that neither the acidic solution nor the base solution damages the textile.

Once the cleaning solution has been worked into the textile and the textile is agitated sufficiently to loosen any soils and other undesirable material on the textile, the vacuum/suction head 24 is passed over the textile to withdraw the solution and the soil, etc. The spray nozzles, agitating means and vacuum head may be actuated independently. Typically, these steps are accomplished by applying the cleaning solution and actuating the agitating means 132 when the cleaning machine 10 is being moved in a forward direction. The vacuum/suction head 24 is then actuated as the cleaning machine is drawn rearwardly over the textile. Those skilled in the art will appreciate that there are typically several different control mechanisms on cleaning machines which allow the user to independently operate certain functions such as solution application, agitation, if provided, and suction.

In accordance with another aspect of the present invention, it has been found that the agitating means 132 can be omitted. Because the carbon dioxide contained in or generated by the cleaning solution(s) performs a substantial amount of the work necessary to lift soils from the textile fibers, the agitating pad may be omitted if the cleaning solution(s) are still actively reacting when disposed on the carpet. Thus, if two cleaning solutions are mixed immediately before application, during application, or one is applied, followed by the other as described above, a greater amount of utilizable carbon dioxide is present due to the proximity of the reaction to its application. If suction is applied to the reacting cleaning composition, carbon dioxide effervescence increases dramatically due to the negative pressure, thereby facilitating release of soil on the textile and reducing the need to manually work the textile. When such a method of cleaning is used with a reciprocating head as shown in FIGS. 1 and 2, it has been found that no agitating means is necessary to achieve remarkably clean fabrics, as the reciprocating vacuum/suction head 24 provides sufficient agitation to ensure that the chemicals are sufficiently combined. The ability to clean quickly and without the use of surfactants with the described method has been consistent even when the textile is covered with hard to remove materials such as mud and oil.

Figure 3:
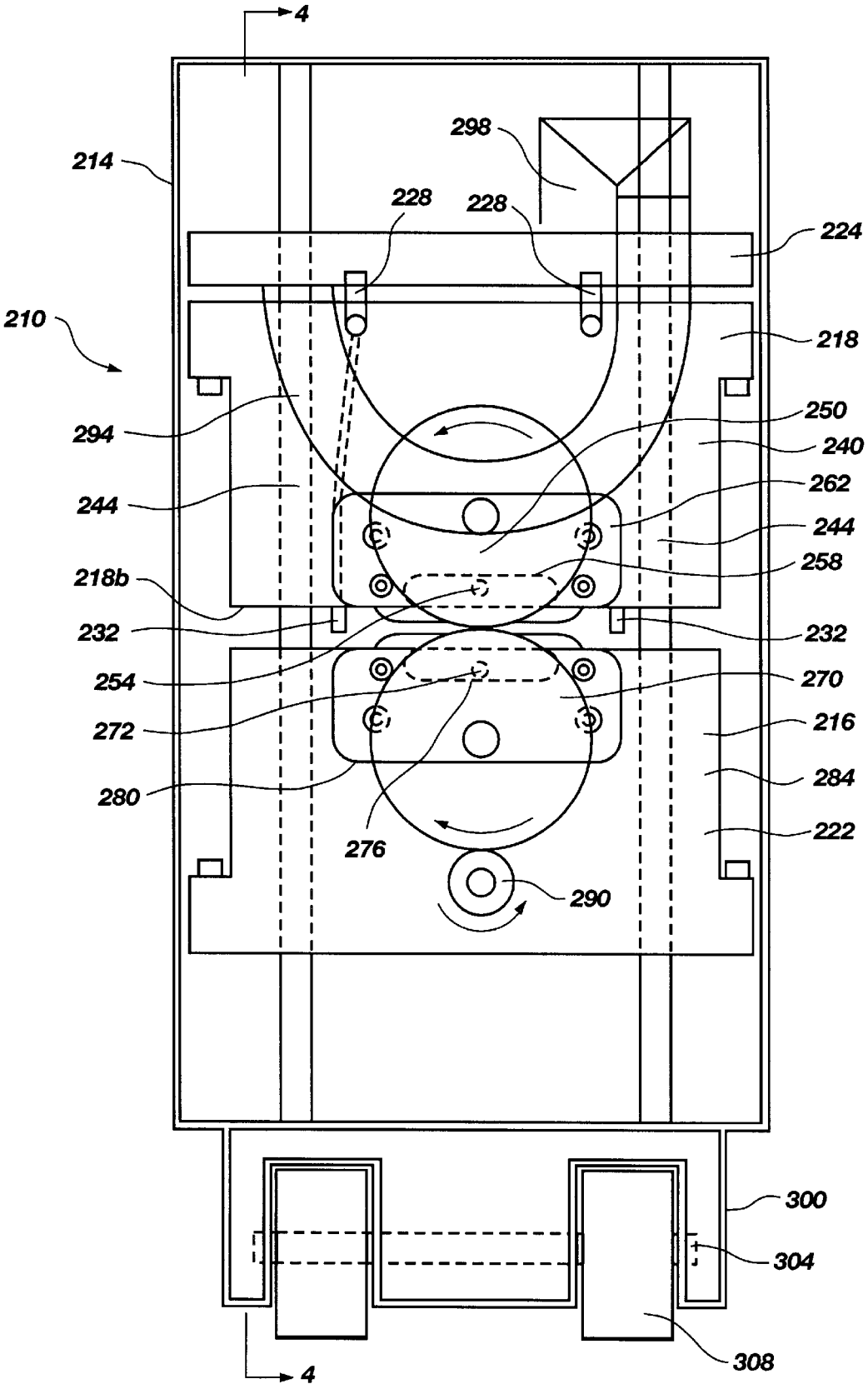
FIG. 3 shows a plan view of an alternate embodiment of a reciprocating head made in accordance with the principles of the present invention.

Referring now to FIG. 3, there is shown a plan view of an alternate embodiment of the present invention. The cleaning machine 210 has a housing 214 and a pair of reciprocating heads 218 and 222 disposed within the housing. Disposed on a first reciprocating head 218 is a vacuum/suction head 224 and a first plurality of spray nozzles 228 which are disposed adjacent the vacuum/suction head 224. Unlike the embodiment shown in FIGS. 1 and 2, a second plurality of spray nozzles 232 may be disposed on a rearward end 218*b* of the first reciprocating head 218. The reason for the second plurality of spray nozzles 232 will be discussed in detail below.

The first reciprocating head 218 includes a support body 240 which slides along a pair of support rails 244 which are disposed in a generally parallel arrangement. The support body 240 is moved forwardly and rearwardly (as shown in FIG. 3) by a first reciprocation gear 250. As the first reciprocation gear 250 is rotated, a pin 254 which extends downwardly from the gear slides within a slot 258 formed in a plate 262 attached to the support body 240. As the pin 254 is moved around the reciprocation gear 250, the plate 262 and the support body 240 are moved forwardly and rearwardly in a reciprocating manner.

Disposed in communication with the first reciprocation gear 250 is a second reciprocation gear 270. The first and second reciprocation gears 250 and 270 are disposed so that rotation of one gear in a first direction causes rotation of the other gear in an opposing second direction. Thus, as shown in FIG. 3, when the first reciprocation gear 250 rotates counter-clockwise, the second reciprocation gear 270 will rotate clockwise.

The second reciprocation gear 270 has a pin 272 which slides within a slot 276 in a plate 280 attached to a support body 284 of the second reciprocating head 222. As with the first reciprocating head 218, the second reciprocating head 222 slides along the support shafts 244.

The pins 254 and 272 attached to the gears 250 and 270 are disposed in a synchronized fashion to ensure that the reciprocating heads 218 and 222 move to an equal degree in opposite directions. When the reciprocating heads 218 and 222 are disposed adjacent one another, the pins 254 and 272 will be disposed adjacent one another. Turning either of the gears 250 or 270 causes the other gear to move a similar distance in the opposite direction. Thus, when pin 254 has been moved 180 degrees about the gear 250 so as to move the first reciprocating head 218 to its forwardmost extreme, the pin 272 has been rotated 180 degrees about the gear 270 so as to move the second reciprocating head 222 to its rearwardmost extreme. The advantage of such an arrangement is that the vibrations created by the movements of the reciprocating heads 218 and 222 will always tend to cancel each other out. This lessens the vibration to which the user is subjected, and prevents accidental movement as is often caused with a single reciprocating head. If the cleaning machine 210 is released while the reciprocating heads 218 and 222 are still moving, the machine will not lurch forward, backward, or to either side as will many reciprocating cleaning machines of the prior art. Rather, the cleaning device 210 will remain generally stationary.

Both of the drive gears 250 and 270 are turned by a motor gear 290 which is powered by a motor (not shown) attached to the housing 214. It will be appreciated that neither the drive gears 250 and 270 nor the motor gear 290 move relative to the housing 214, except in a rotational pattern. Rather, the movement of the reciprocating heads 218 and 222 are dependent on movement of the pins as the gears 250, 270 and 290 rotate. Such an arrangement simplifies construction and produces less wear and tear on the respective parts.

The second plurality of spray nozzles 232 are provided to apply cleaning solution to the textile being cleaned just before the second reciprocating head 222 passes over the textiles. While the spray nozzles 232 could be disposed on the housing 214 or the second reciprocating head 222, attaching them to the first reciprocating head allows for a common attachment point with the first plurality of spray nozzles which are disposed on the opposite side of the first reciprocating head. This eliminates the need for feed lines to extend to several different parts of the cleaning machine 210 and simplifies maintenance.

Once the cleaning solution has been worked into the textile by the agitating means (discussed in FIG. 4) of the reciprocating heads 218 and 222, the solution and soils are removed from the textile by the vacuum/suction head 224 which is provided with suction by a flexible hose 294 similar to that discussed with respect to the embodiment shown in FIG. 1. The solution and soils are passed through the hose 294 to a suction port 298 into which a conventional vacuum hose will usually be mounted.

Also shown in FIG. 3 is a support 300 which is disposed at the back of the housing 214. The support 300 receives an axle 304 about which two or more wheels 308 rotate. As will be discussed with respect to FIG. 4, the height of the axle 304 can be adjusted to change the height of the wheels 308, thereby enabling adaptation for different textile heights. Jul. 25, 1996

Figure 4:
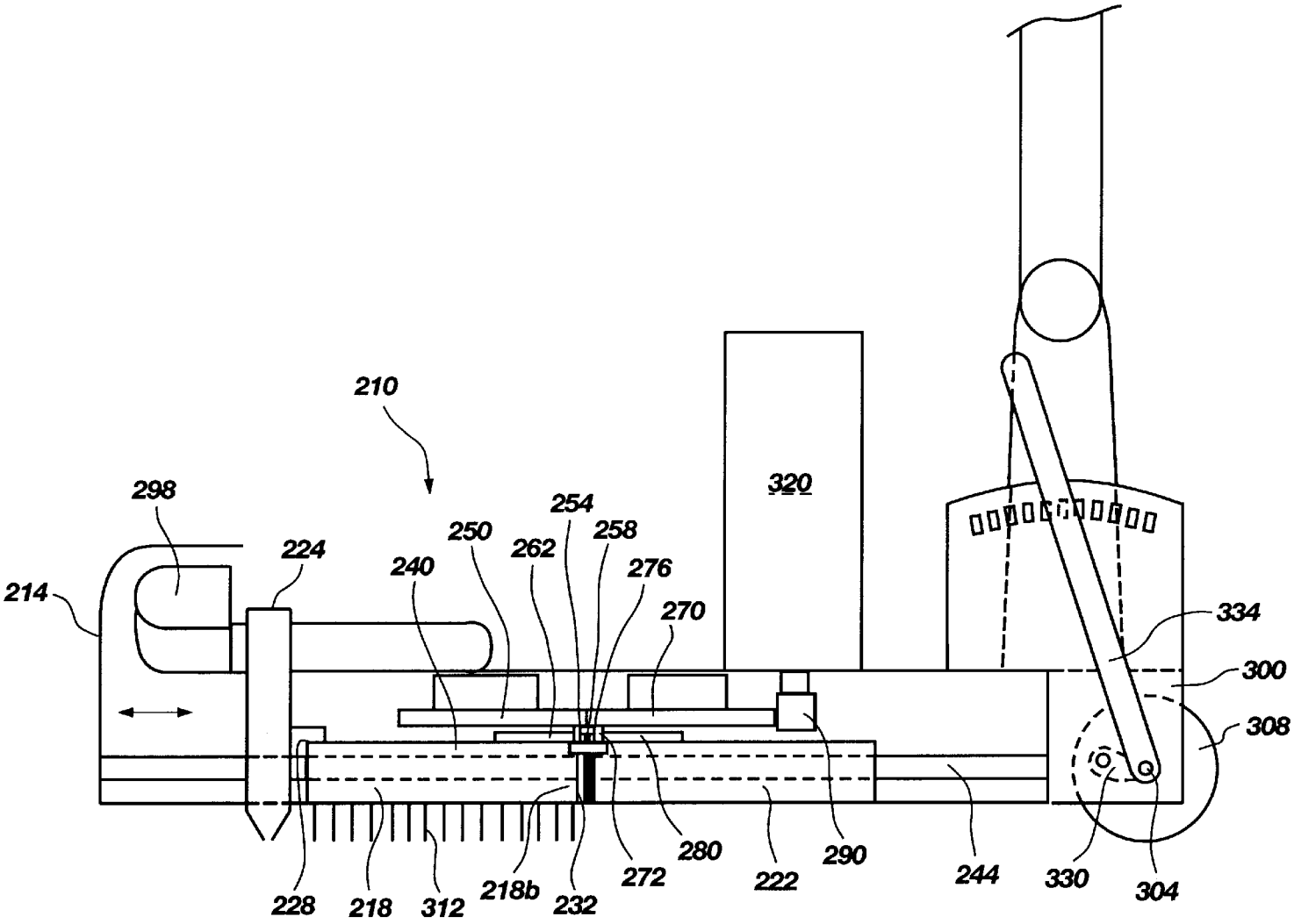
FIG. 4 shows a side view of the cleaning device shown in FIG. 3.

Referring now to FIG. 4, there is shown a simplified side view of the cleaning machine 210 taken along lines 4—4 of FIG. 3. The housing 214 of the cleaning machine 213 holds the pair of reciprocating heads 218 and 222 which are slidably mounted on the support shafts 244 which extend substantially the length of the housing 214. The reciprocating heads 218 and 222 can contain bearings or other devices to keep friction to a minimum as the heads move forwardly and rearwardly (to the left and to the right in FIG. 4) along the support shafts 240 and 244.

As shown in FIG. 4, the first reciprocating head 218 contains an agitating means 312 attached to a bottom side thereof, while the second reciprocating head 222 does not. Typically, both will contain an agitating means or neither will. Whether an agitating means is provided depends largely on the chemical solution which is distributed by the cleaning machine 210 to the textile to be cleaned. If the chemical solution generates a sufficient amount of carbon dioxide upon application, it is generally unnecessary to include the agitating means 312 because carbon dioxide effervescence enhances the agitation provided by the vacuum/suction head 224 and lift soils to the surface.

The first reciprocating head 218 also carries the vacuum/suction head 224 and a first plurality of spray nozzles 228 which are disposed adjacent the vacuum/suction head 224. The first plurality of spray nozzles may be disposed within the vacuum/suction head 224 or outside of the vacuum/suction head. Which position the spray nozzles are disposed in will depend on the strength of the vacuum applied by the vacuum suction head 224. While the negative pressure of the suction promotes carbon dioxide effervescence in solutions such as those discussed above, a very strong vacuum could suction away the cleaning solution(s) before it has time to fully penetrate the textile to be cleaned.

Also shown on the first reciprocating head 218 are the second plurality of spray nozzles 232 disposed on a rearward end 218*b*. As has been explained earlier, it has been found that superior cleaning can be achieved by applying a first chemical, typically a carbonate salt base, to a textile fiber, and then adding a second chemical, typically an organic acid, to cause a reaction which promotes cleaning of the textile. For example, it is known that a base with a relatively high pH provides enhanced cleaning of carpet fibers. However, the high pH will often damage the fibers and cause "brown out." In accordance with the present invention, the base solution is applied to the fibers by the second plurality of spray nozzles 232. The base solution is allowed to seep into the textile fibers for approximately as much time as it takes to move the first plurality of spray nozzles 228 over the same area (typically not more than 1 to 3 seconds). While the cleaning machine 210 is being backed over the base covered textile, the textile may be agitated by the agitating pad 312 if provided. The acid solution is then applied through the first plurality of spray nozzles. The acid solution neutralizes the base solution to prevent damage to the fibers. By utilizing a carbonate salt as the base solution, the addition of the acid solution brings about a chemical reaction causing generation of a large quantity of carbon dioxide which effervesces through the textile fibers. This is further enhanced by applying suction creating a negative pressure to the reacting solutions.

Because the base solution is given sufficient time to at least partially penetrate the fibers, the carbonation reaction and resultant carbon dioxide effervescence occur at least on the surface of the fibers, if not partially therein. In such a manner, the solution is better able to break free soils disposed on the surface of the fibers. The carbon dioxide effervescence carries the released soil to the surface where it is suctioned away by the vacuum/suction head 224.

The amount of carbon dioxide generated will be a function of the concentration of acid and carbonate salt in the solutions. The amount of carbon dioxide generated from the reaction of an acid with a carbonate salt will be the same at all temperatures. However, the solubility of carbon dioxide in water decreases exponentially as the temperature of the carbonating solution is increased. The effervescence noted upon application of a carbon dioxide containing solution to a textile surface is an indication of the effective utilization of the carbon dioxide generated. The combining of hot carbonating acid and carbonate salt solutions coincident with their application to textile fibers optimizes effervescence or the utilization of the carbon dioxide produced.

To provide the reciprocating action of the vacuum/suction head described above, the first reciprocating head 218 is driven by the first reciprocation gear 250 and the interaction of its pin 254 extending downwardly through the slot 258 formed in the plate 262 attached to the support body 240.

The reciprocating gear 250 is driven by the second reciprocation gear 270. The first and second reciprocation gears 250 and 270 are disposed so that rotation of one gear in a first direction causes rotation of the other gear in an opposing second direction. Thus, as was shown in FIG. 3, when the first reciprocation gear 250 rotates counterclockwise, the second reciprocation gear 270 will be rotating clockwise. The pin 272 of the reciprocation gear 270 slides within the slot 276 in the plate 280 attached to the support body 284. In such a manner, the vibrational forces generated by each reciprocating head are offset by the vibrational forces generated by the other.

The second reciprocation gear 270 is driven by the motor gear 290 which is, in turn, driven by the motor 320. As was mentioned previously, the reciprocation gears 250 and 270 interact with the plates 262 and 280 in such a manner that the motor gear 290 may be rotated in either direction without changing the reciprocating pattern of the first and second support bodies 218 and 222.

Also shown in FIG. 4 is the support 300 which receives the axle 304 supporting the wheels 308. A cam mechanism 330 and lever 334 are attached to the axle 304 to enable the user to adjust the position of the wheels 308 relative to the housing. As will be appreciated from FIG. 4, if no agitating means 312 are used on the support bodies 218 and 222, the housing 214 is held above the textile by only the wheels 304 and the vacuum/suction head 224. Thus, adjustment of the position of the wheels provides improved control when working on carpet and other textiles which have different thicknesses.

Figure 5:
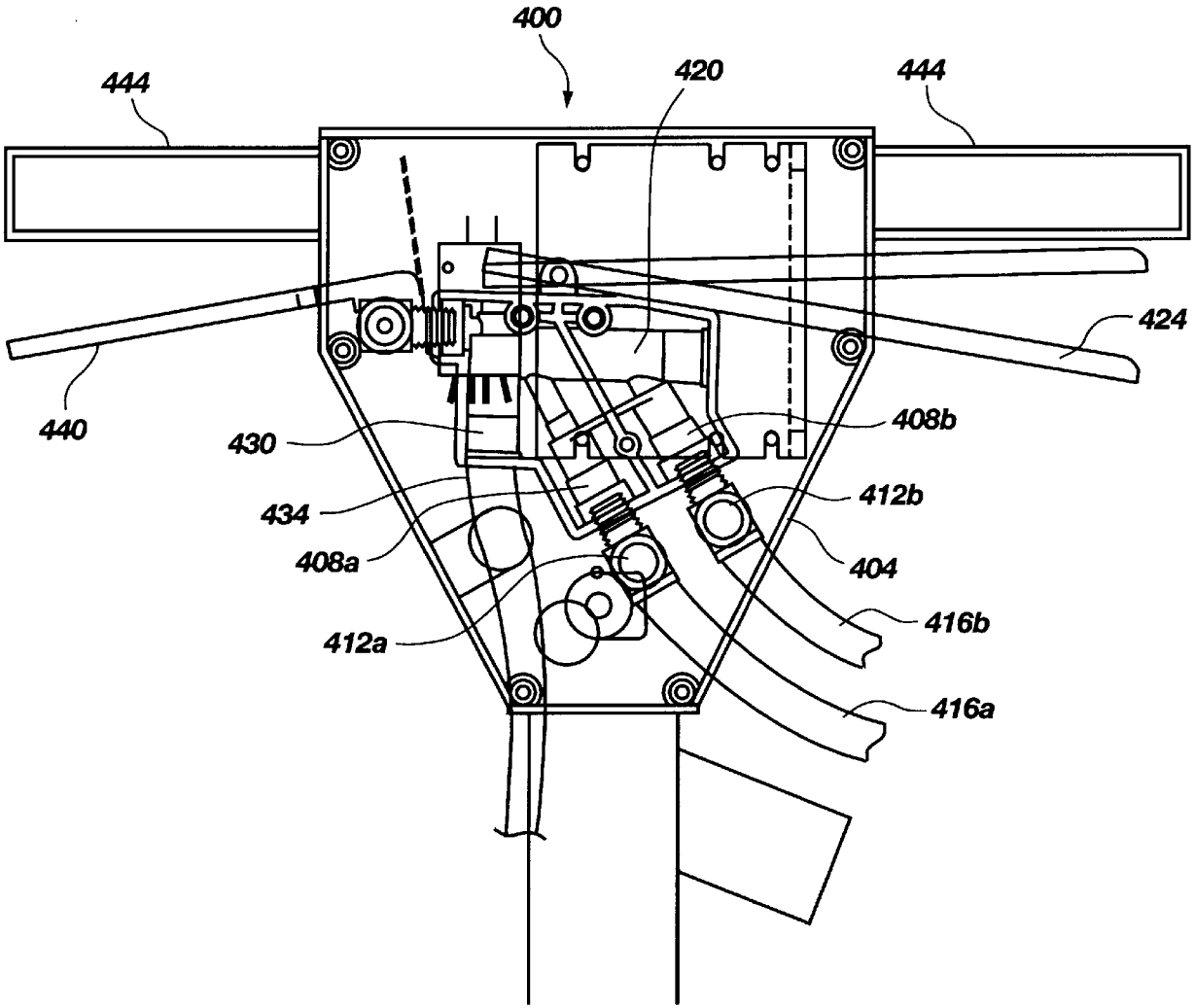
FIG. 5 shows a cross-sectional view of a control unit of the present invention as may be used with the cleaning devices shown in FIGS. 1 through 4.

Turning now to FIG. 5, there is shown a cross-sectional view of a control unit of the present invention as may be used with the reciprocating head shown in FIGS. 1 through 5. The control unit, generally indicated at 400, includes a housing 404 having a first receiving port 408*a* and a second receiving port 408*b*. Disposed in each port 408*a* and 408*b* is a valve 412*a* and 412*b*, respectively which connects the port to connected to a first inflow line 416*a* and a second inflow line 416*b*. One of the inflow lines will typically carry a carbonate salt base solution, while the other will carry an acid solution.

The inlet ports 408*a* and 408*b* lead to a mixing chamber 420 wherein the acid and base solutions may be mixed to form a carbonating solution for carbon dioxide generation solution. Flow through the valves 412*a* and 412*b* is typically controlled by a lever 424 or other control mechanism. The lever 424 can be connected to the valves 412*a* and 412*b* in such a manner as to allow only release of both solutions simultaneously. In the alternative, the lever 424 may be connected to the valves 412*a* and 412*b* in such a manner as to enable either simultaneous release, or alternating release of the base and acid solutions. Thus, the lever 424 could be used to first apply a base solution to the textile, followed by a neutralizing acid solution.

Once either solution or a mixture thereof passes through the mixing chamber 420, it passes through an outlet port 430 and out a feed line 434 that leads to the spray nozzles 28 or 228 on the reciprocating head 18 or 218. The solution or mixture is then applied to the textile in the manner described above.

In the event that two separate sets of spray nozzles are provided for independently spraying an acid solution and a base solution, the mixing chamber 420 will typically be omitted and are pair of feed lines similar to feed line 434 will be provided.

A similar valve arrangement and different mechanisms for ensuring that the acid and base solutions are properly mixed is set fort in U.S. Pat. No. 5,593,091 (U.S. patent application Ser. No. 08/335,210), which is expressly incorporated herein.

The control unit 400 shown in FIG. 5 is not meant to be limiting as to the configuration of the controls, or to limit the number of solutions which may be applied to two. For example, it is well known that ammonia (including certain amines, urea and ammonium salts) is a powerful cleaner for many textiles and other materials. Traditionally, however, ammonia has been avoided because the pungent odor which is associated therewith. In accordance with the present invention, it has been found that incorporating ammonia in an acid solution, which may also be buffered, neutralizes the odor without destroying the cleaning power of the ammonia. Therefore, the acid solution could contain ammonia. In the alternative, the control unit 400 could be configured with an additional valve arrangement which allows ammonia to be separately released into the acid solution when desired by the person operating the device.

In addition to controls for the cleaning solutions, the control unit 400 also typically includes a control mechanism, such as lever 440 which allows the user to activate/deactivate movement of the reciprocating head(s). For ease of use, the levers 424 and 440 are disposed adjacent handles which are used by the operator to guide the machine. Thus, the operator can control each aspect of the machine's operation without relinquishing control thereof.

Yet another advantage of the present invention is that a noticeable reduction in drying time is achieved. By applying the cleaning solutions and then quickly removing the same with the negative pressure of the vacuum/suction head, the carpet is wet for a shorter period of time. The decreased wetness decreases the risk of damage to the carpet, and it generally more convenient for the owner of the carpet as furniture and other items are displaced for a shorter period of time.

Thus there is disclosed a reciprocating head for cleaning textiles and several methods which may be implemented with the device. Those skilled in the art will recognize numerous modifications which may be made without departing from the scope of spirit of the invention. The appended claims are intended to cover such modifications.

What is claimed is:

1. A mobile cleaning machine for traversing over and cleaning textiles, the cleaning machine comprising:

housing means;

support means disposed in contact with the housing means, and disposed for slidable engagement with at least one reciprocating head which moves substantially within the housing means;

at least one reciprocating head horizontally moveable in between a first forward position and a second backward position;

at least one downwardly directed spray nozzle means disposed adjacent to the reciprocating head for spraying at least one cleaning solution onto the textile;

inflow lines for providing a first solution and a second solution;

control means for selectively releasing a mixture of the first and second solutions on the textile through the spray nozzle means, the control means comprising a mixing chamber for receiving the first and second solutions from the inflow lines, and for mixing the first and second solutions so as to form a cleaning solution for spraying through the at least one spraying nozzle means; and a suction head attached to the at least one reciprocating head to remove solution from the textile as the suction head reciprocates and said machine traverses the textile.

2. The cleaning machine of claim 1, wherein the control means comprises at least one valve for controlling flow from the first and second inflow lines.

3. The cleaning machine of claim 1, wherein the machine further comprises a reciprocating gear disposed in communication with the at least one reciprocating head and a motor means disposed in communication with the reciprocation gear for turning the reciprocation gear so as to move the at least one reciprocating head between the first and second positions.

4. The cleaning machine of claim 3, wherein the machine further comprises a plate attached to the at least one reciprocating head, the plate having a slot formed therein, and a pin extending from the reciprocation gear into the slot such that rotation of the reciprocation gear moves the pin within the slot and moves the at least one reciprocation plate between the first and second positions.

5. The cleaning machine of claim 3, wherein the motor means further comprises a motor gear disposed in contact with the reciprocation gear.

6. The cleaning machine of claim 1, wherein the at least one reciprocating head comprises a first reciprocating head and a second reciprocating head disposed adjacent one another, each having a first forward position and a second rearward position, and further comprising reciprocating gear means connected to the first and second reciprocating heads for moving the reciprocating heads between the first forward position and the second rearward position such that when one reciprocating head is disposed in the first forward position, the other reciprocating head is disposed in the second, rearward position.

7. A cleaning machine for cleaning textiles, the cleaning machine comprising:

a support means for slidably holding a first reciprocating head and a second reciprocating head;

a first reciprocating head moveable between a first forward position and a second rearward position;

a second reciprocating head movable between a first forward position and a second rearward position, the second reciprocating head moving opposite the first reciprocating head such that when the first reciprocating head is in its second rearward position, the second reciprocating head is in its first forward rearward position and disposed adjacent the first reciprocating head, and when the first reciprocating head is in its first forward position, the second reciprocating head is in its second rearward position, spaced from the first reciprocating head;

means for moving the first and second reciprocating heads;

at least one spray nozzle disposed adjacent to one of the reciprocating heads for spraying at least one cleaning solution on a textile;

at least one feed line for providing at least one cleaning solution to the spray nozzles for spraying on the textile;

control means for selectively controlling supply of the cleaning solution through the at least one feed line and for controlling actuating and terminating movement of the reciprocating heads; and a suction head attached to at least one of the reciprocating heads for moving along the textile so as to remove the cleaning solution from the textile as the suction head reciprocates.

8. The cleaning machine of claim 7, wherein the machine comprises a first plurality of spray nozzles and a second plurality of spray nozzles, each plurality of spray nozzles being connected to the control means so as to receive different cleaning solutions.

9. The cleaning machine of claim 7, wherein the means for moving the first and second reciprocating heads comprises first and second reciprocation gears, one gear being disposed adjacent each reciprocating head.

10. The cleaning machine of claim 9, wherein the first and second reciprocation gears are disposed in contact with one another such that rotation of one of the reciprocation gears in a first direction causes the other reciprocation gear to rotate in the opposite direction.

11. The cleaning machine of claim 9, wherein the means for moving the first and second reciprocating heads comprises a motor having a motor gear for engaging at least one of the reciprocation gears.

12. A cleaning machine for cleaning textiles, the cleaning machine comprising:

a support means for slidably holding a first reciprocating head and a second reciprocating head;

a first reciprocating head moveable between a first forward position and a second rearward position;

a second reciprocating head movable in a direction opposite the first reciprocating head;

means for moving the first and second reciprocating heads including first and second reciprocation gears, one gear being disposed adjacent each reciprocating head;

at least one spray nozzle disposed adjacent to one of the reciprocating heads for spraying at least one cleaning solution on a textile;

at least one feed line for providing at least one cleaning solution to the spray nozzles for spraying on the textile;

control means for selectively controlling supply of the cleaning solution through the at least one feed line and for controlling actuating and terminating movement of the reciprocating heads;

a suction head attached to the reciprocating head for moving along the textile so as to remove the cleaning solution from the textile as the suction head reciprocates; and wherein each reciprocating head has a plate with a slot formed therein, and wherein each reciprocation gear has a pin extending downwardly therefrom into the slot of one of the plates such that rotation of the reciprocation gear moves the pin within the slot, thereby moving the reciprocating head forwardly or rearwardly.

13. The cleaning machine of claim 7, further comprising at least one agitating pad attached one of the reciprocating heads and disposed so as to contact the textile.

14. The cleaning machine of claim 7, wherein the at least one spray nozzle is disposed within the suction head.

15. The cleaning machine of claim 14, wherein the at least one spray nozzle is disposed on the first reciprocating head.

16. A mobile cleaning machine for cleaning carpets, the machine comprising:

housing means for holding at least one reciprocating head;

a first reciprocating head movable along a linear path between a first forward position and a second rearward position;

a second reciprocating head movable along a linear path between a first forward position adjacent the second rearward position of the first reciprocating head, and a second rearward position rearward of the first forward position of the second reciprocating head;

support means for supporting the first and second reciprocating heads as they move between respective first forward positions and second rearward positions;

reciprocation gear means disposed in communication with the first and second reciprocating heads for moving the first and second reciprocating heads in such a manner that the first reciprocating head is disposed in its first forward position when the second reciprocating head is disposed in its second rearward position, and so that the first reciprocating head is disposed in its second rearward position when the second reciprocating head is disposed in its first forward position;

a plurality of spray nozzles connected to at least one of the reciprocating heads for spraying cleaning solution on a textile to be cleaned when passed over by the reciprocating heads;

supply means for supplying cleaning solution to the spray nozzles; and suction means connected to one of the first and second reciprocating heads for reciprocating movement for removing cleaning solution from the textile to be cleaned.

17. The cleaning machine of claim 16, wherein an agitation means is connected to at least one of the reciprocating heads.

18. The cleaning machine of claim 16, wherein the reciprocation gear means comprises a first gear disposed above the first reciprocating head and a second gear disposed above the second reciprocating head, the first gear and the second gear being disposed in contact such that rotation of the first gear in a clockwise direction causes rotation of the second gear in a counter-clockwise direction and vice-versa.

19. The cleaning machine of claim 18, wherein the cleaning machine further comprises motor means disposed in communication with at least one of the reciprocating gears.

* * * * *